US005954570A

United States Patent [19]

Yano et al.

[11] Patent Number: 5,954,570

[45] **Date of Patent: *Sep. 21, 1999**

[54] CONDITIONER FOR A POLISHING TOOL

[75] Inventors: Hiroyuki Yano; Katsuya Okumura, both of Yokohama; Norio Kimura, Fuijsawa; Noburu Shimizu, Yokohama, all of Japan

[73] Assignee: Kabushiki Kaisha Toshiba, Kawasaki, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/656,643

[22] Filed: May 31, 1996

[51] Int. Cl.[6] ..... B24B 29/00

[52] U.S. Cl. ..... 451/285; 451/56; 451/443

[58] Field of Search ..... 451/56, 285, 287, 451/288, 443

[56] References Cited

U.S. PATENT DOCUMENTS

| | | | |
|---|---|---|---|
| 2,541,912 | 2/1951 | Broughton | 451/56 |
| 4,149,343 | 4/1979 | Feldmeier | 451/285 |
| 5,010,692 | 4/1991 | Ishida et al. | 51/283 R |
| 5,035,087 | 7/1991 | Nishiguchi et al. | 451/285 |
| 5,081,051 | 1/1992 | Mattingly et al. | 437/10 |
| 5,216,843 | 6/1993 | Breivogel et al. | 51/131.1 |
| 5,245,796 | 9/1993 | Miller et al. | 51/283 R |
| 5,456,627 | 10/1995 | Jackson et al. | 451/56 |
| 5,486,131 | 1/1996 | Cesna et al. | 451/56 |
| 5,516,327 | 5/1996 | Kawasaki | 451/285 |
| 5,536,202 | 7/1996 | Appel et al. | 451/285 |
| 5,538,460 | 7/1996 | Onodera | 451/56 |
| 5,547,417 | 8/1996 | Breivogel et al. | 451/443 |

*Primary Examiner*—Eileen P. Morgan

[57] ABSTRACT

A conditioner assembly for a polishing machine includes a carrier, a conditioning element attached to the carrier, and an elastic element arranged between the conditioning element and the carrier. The conditioner assembly improves the polishing uniformity across the surface of a workpiece.

25 Claims, 9 Drawing Sheets

FIG. 2A
PRIOR ART
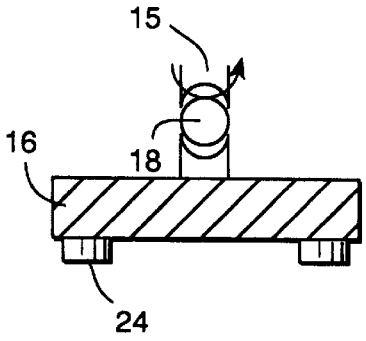
FIG. 2B
PRIOR ART
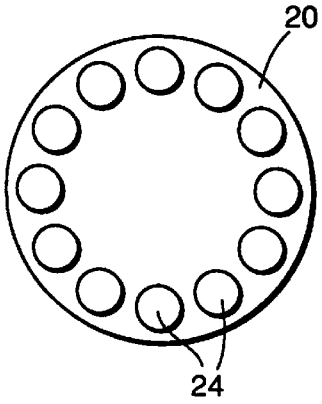
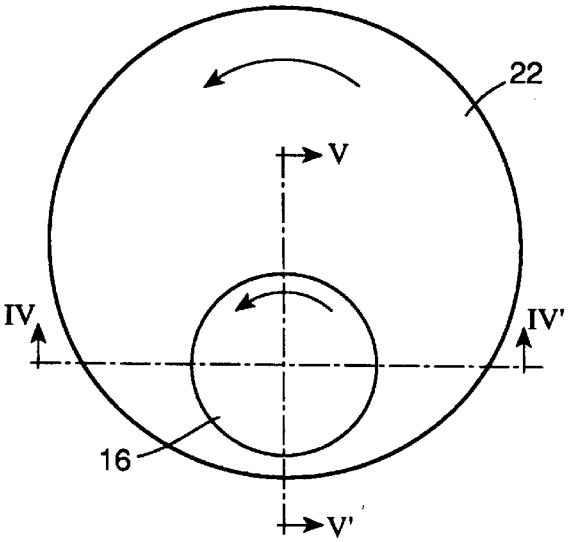
FIG. 3A
PRIOR ART
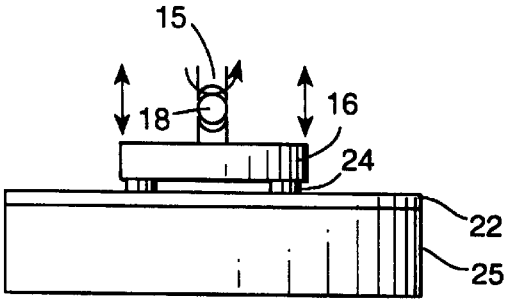
FIG. 3B
PRIOR ART FIG. 7A
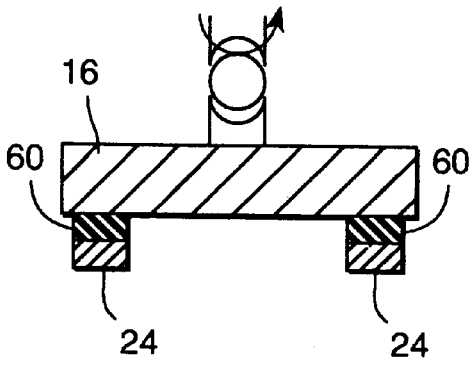
FIG. 7B
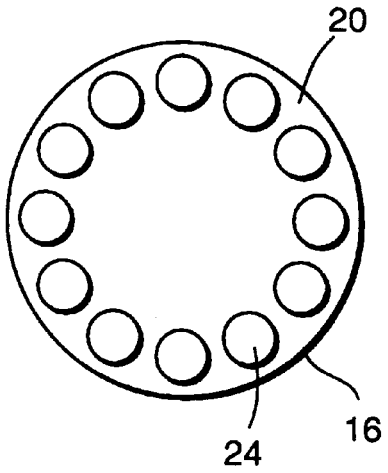
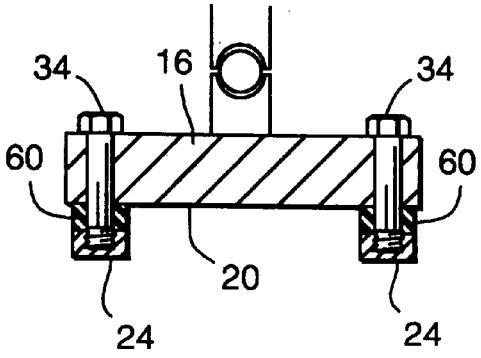
FIG. 8A
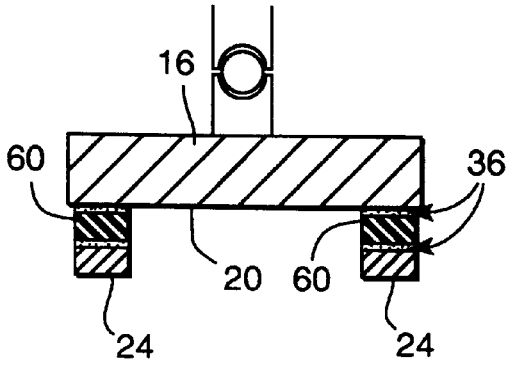
FIG. 8B After 20sec.X 30 times conditioning

CONDITIONER FOR A POLISHING TOOL

BACKGROUND OF THE INVENTION

1. Technical Field

The present invention generally relates to a polishing tool for polishing a workpiece and, more particularly, to a conditioner for a polishing tool for polishing a workpiece such as a semiconductor wafer.

2. Description of the Related Art

Machines for preparing and fabricating semiconductor wafers are known in the art. Wafer preparation includes slicing semiconductor crystals into thin sheets, and polishing the sliced wafers to free them of surface irregularities, that is, to achieve a planar surface. In general, the polishing is accomplished in at least two steps. The first step is a rough polishing or abrasion. This step may be performed by an abrasive slurry lapping process in which a wafer mounted on a rotating carrier is brought into contact with a rotating polishing pad upon which is sprayed a slurry of insoluble abrasive particles suspended in a liquid. Material is removed from the wafer by the mechanical buffing action of the slurry. The second step is fine polishing. The fine polishing step is performed in a similar manner to the abrasion step, however, a slurry containing less abrasive particles is used. Alternatively, a polishing pad made of a less abrasive material may be used. The fine polishing step often includes a chemical mechanical polishing ("CMP") process. CMP is a combination of mechanical and chemical abrasion, and may be performed with an acidic or basic slurry. Material is removed from the wafer due to both the mechanical buffing and the action of the acid or base. Such polishing is also important during the manufacturing of semiconductor devices in order to planarize various thin film layers formed on the surface of a semiconductor wafer. The thin film may, for example, be an interlayer insulating film formed between two metal layers, a metal layer, an organic layer, or a layer of semiconductor material. Polishing apparatus are disclosed, for example, in U.S. Pat. Nos. 5,245,796 and 5,216,843.

One important factor to achieving and maintaining a high and stable polishing rate is pad conditioning. Conditioning is generally performed after each wafer is polished in order to remove debris and grit and to make the pad surface rough. By this procedure, the pad can absorb or hold enough fresh slurry to achieve a high and stable polishing rate. Conditioning also contributes to the uniformity of polishing.

A wafer polishing apparatus 10 is generally shown in FIG. 1. Wafer polishing apparatus 10 includes a pad conditioning assembly 12 and a wafer carrier assembly 14. Pad conditioning assembly 12 includes a shaft 15 which is connected to a conditioning element carrier 16. Shaft 15 includes a joint 18 such as a ball and socket joint for maintaining planar contact between the bottom surface 20 of diamond pellet carrier 16 and a pad 22. Shaft 15 may be rotated by a motor (not shown) to impart rotational motion to carrier 16. Wafer carrier assembly 14 includes a carrier 42 for applying a downward pressure against the backside of a wafer 44. The backside of wafer 44 is held in contact with the bottom of carrier 42 by a vacuum or by wet surface tension. An insert pad 46 may be provided between the backside of wafer 44 and carrier 42. Carrier 42 includes downwardly extending sidewall portions to prevent wafer 44 from slipping laterally from under carrier 42 during processing. The downward pressure is applied by means of a shaft 48 connected to carrier 42. Shaft 48 includes a joint 50 to maintain planar contact between carrier 42 and polishing pad 22. Shaft 48 may be rotated by a motor (not shown) to rotate wafer 44 and enhance the polishing process. As can be seen with reference to FIGS. 1 and 2, conditioning elements 24 project outwardly from bottom surface 20 of conditioning element carrier 16. Conditioning elements 24 may, for example, be diamond conditioning elements. As shown in views of FIGS. 3A and 3B, in operation, conditioning elements 24 of pad conditioner assembly 12 are embedded into pad 22 and pad conditioner assembly 12 is rotated in a counterclockwise direction at a rate of 60 rotations per minute (RPM), for example. Polishing pad 22 is fixedly attached to an upper surface of a rotatable table 25. The pad may, for example, be an IC-1000/SUBA-N double layered pad. In operation, table 25 is rotated in a counterclockwise direction at a rate of 100 RPM, for example. The rotational motion of table 25 may be provided by a motor (not shown).

As indicated in FIG. 3B, pad conditioner assembly 10 is subject to unstable motion during operation. For example, as shown in FIG. 4A, during the conditioning operation, a high friction point 30 can exist between conditioning elements 24 and polishing pad 22. If the conditioning assembly 12 is moving to the left as indicated by the arrow in FIG. 4A, conditioning element carrier 16 can "skip" as shown in FIG. 4B. This skipping generates an unstable motion which creates a topography 32 on the surface of polishing pad 22 as shown in FIG. 3C and results in non-uniformity of the polishing of the wafer. This effect is illustrated in FIGS. 5A and 5B. FIG. 5A illustrates the polishing rate in Ångstroms per minute as a function of position across the wafer. It can be seen with reference to FIG. 5A that the polishing rate is fairly uniform and ranges from about 900 to about 1000 Ångstroms per minute after conditioning has been performed three times. However, as can be seen with reference to FIG. 5B, after conditioning has been performed thirty times, the polishing rate varies from less than 800 to more than 1000 Ångstroms per minute across the wafer surface. In particular, the polishing rate of at the center of the wafer becomes very slow because the down-force or pressure at the center of the wafer is low due to the topography 32 on polishing pad 22.

SUMMARY OF THE INVENTION

According to a first aspect of the present invention, a conditioner assembly for a polishing machine includes a carrier, a conditioning element attached to the carrier, and an elastic element arranged between the conditioning element and the carrier.

According to another aspect of the present invention, a polishing apparatus includes a polishing pad, a carrier for bringing a semiconductor wafer in contact with the polishing pad, and a pad conditioner assembly for conditioning the polishing pad. The pad conditioner assembly includes a carrier, a conditioning element attached to the carrier, and an elastic element arranged between the conditioning element and the carrier. In accordance with this aspect of the invention, a topography is not formed in the polishing pad and the down-force or pressure at the center of a workpiece being polished is not reduced. Accordingly, uneven polishing is reduced.

The present invention, as well as the features and advantages thereof, will be explained in the detailed description that follows, making reference to the accompanying drawings.

BRIEF DESCRIPTION OF THE DRAWINGS

FIG. 2A is a cross-sectional view of pad conditioner assembly 12 taken along line I–I' of FIG. 1.

FIG. 2B is a bottom plan view taken along line II–II' of FIG. 1.

FIG. 3A is a top view of the conditioning assembly in operation taken along line III–III' of FIG. 1 (polishing assembly 14 not shown).

FIG. 3B is a sectional view taken along line IV–IV' of FIG. 3A.

FIG. 7A is a cross-sectional view taken along line VI–VI' of FIG. 6.

FIG. 7B is a bottom plan view taken along line VII–VII' of FIG. 6.

FIGS. 8A and 8B illustrate arrangements for securing the elastic members of the present invention to the conditioner plate.

DETAILED DESCRIPTION

Figure 1:
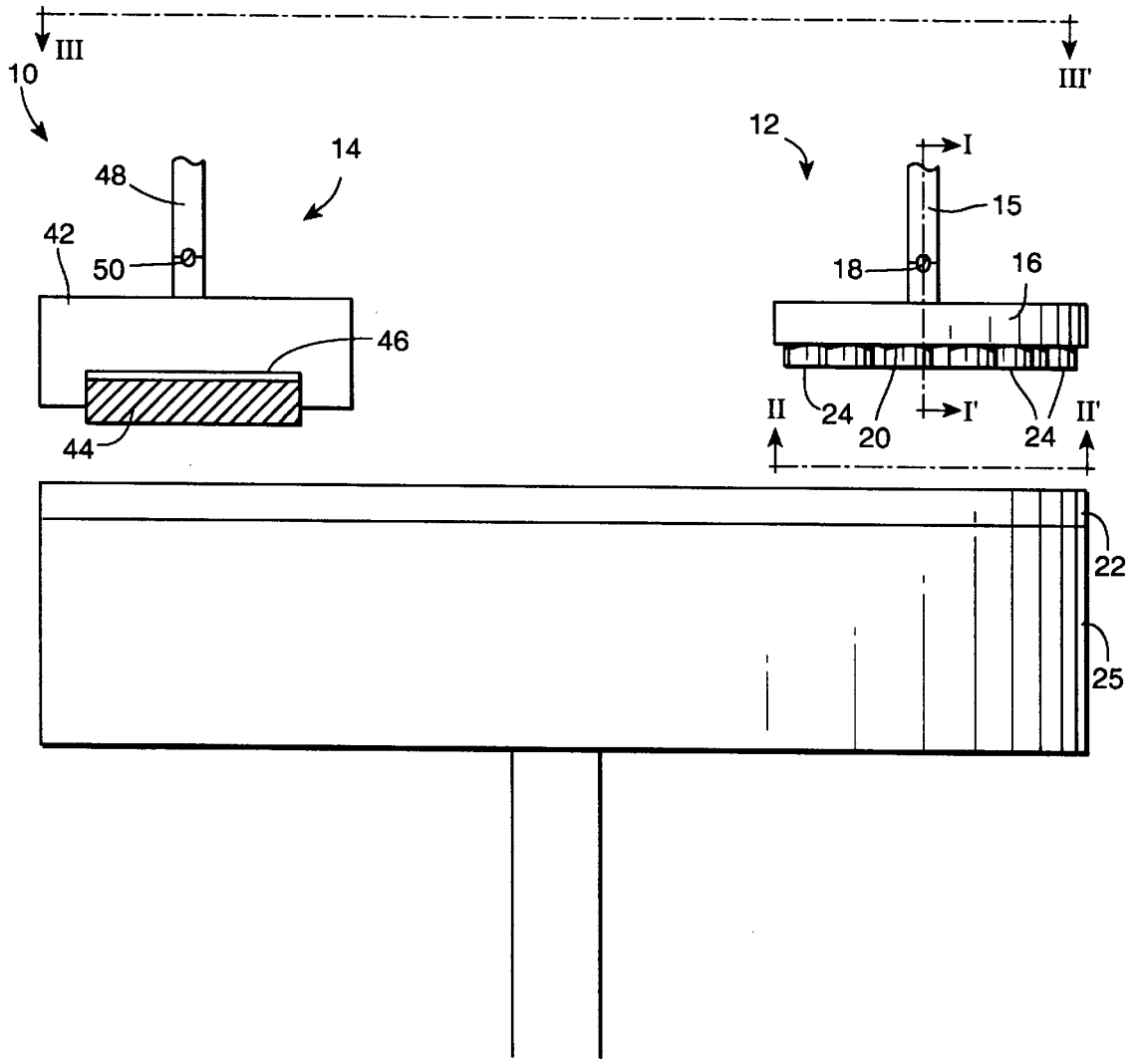
FIG. 1 PRIOR ART
FIG. 1 illustrates a conventional wafer polishing apparatus.
Figure 3C:
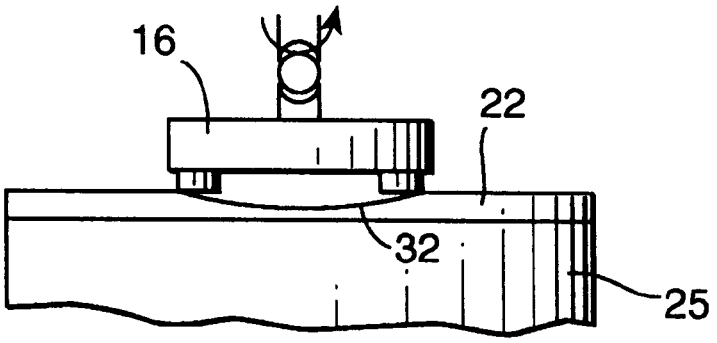
FIG. 3C PRIOR ART
FIG. 3C is a sectional view taken along line V–V' of FIG. 3A illustrating a topography formed in the polishing pad due to unstable motion.

A polishing apparatus 100 including a pad conditioner assembly 102 in accordance with the present invention will be described with reference to FIGS. 6, 7A, and 7B. Pad conditioner assembly 102 of the present invention generally is usable, for example, in a rough polishing apparatus, a fine polishing apparatus, a chemical mechanical polishing apparatus, or any other polishing apparatus including a polishing pad for polishing pad for polishing a workpiece such as a semiconductor wafer. Elements of polishing apparatus 100 which are the same as those of polishing apparatus 10 of FIG. 1 are designated with the same reference numbers and descriptions thereof are omitted.

Figure 6:
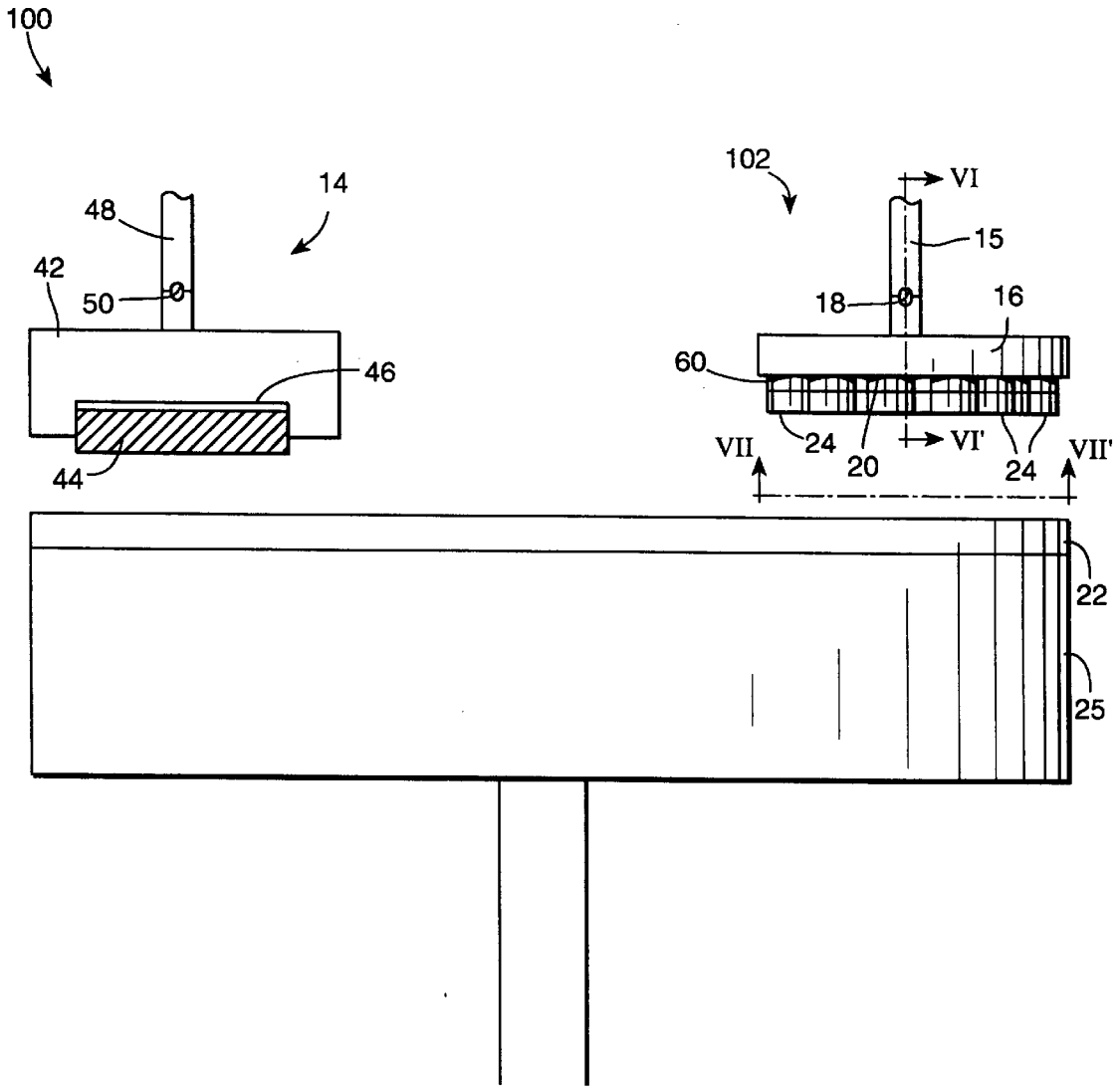
FIGS. 6 illustrates a polishing apparatus in accordance with the present invention.

As shown in FIGS. 6, 7A and 7B, pad conditioner assembly 102 includes elastic members 60 each sandwiched between one of conditioning elements 24 and the bottom surface 20 of conditioning element carrier 16. Elastic members 60 minimize the unstable motion of the pad conditioner assembly and thereby minimize the creation of a topography on the polishing pad. Specifically, elastic members 60 function as dampers to stabilize the motion of the pad conditioner assembly, resulting in more uniform polishing. Suitable materials for elastic members 60 include, but are not limited to, polyurethane sponge and poly-isobuthylene rubber.

Elastic members 60 may be secured in any convenient manner. For example, as shown in FIG. 8A, elastic members 60 may be annular elastic members which receive respective bolts 34 therethrough. Bolts 34 may be threadingly engaged with conditioning element 24. Alternatively, an adhesive such as adhesive tape 36 may be arranged between conditioning elements 24 and elastic members 60 and between elastic members 60 and the bottom surface 20 of conditioning element carrier 16 as shown in FIG. 8B. Of course, these arrangements are for illustrative purposes only, and the invention is not limited in this respect.

Figure 9:
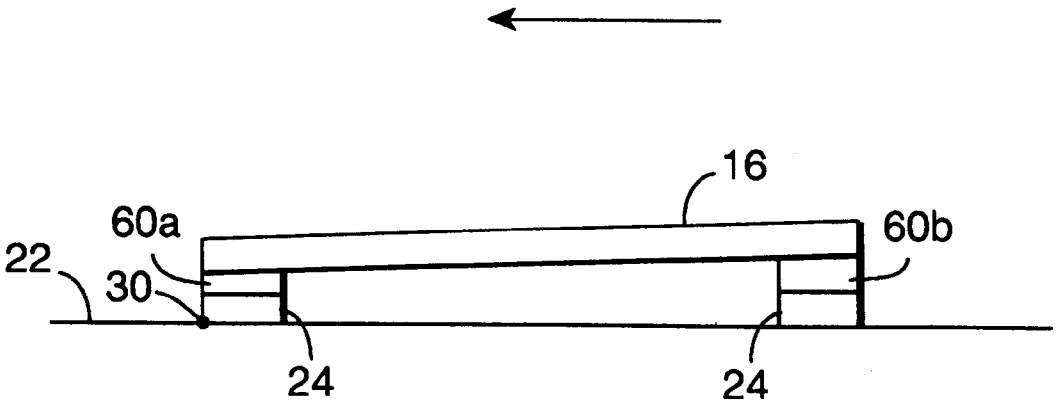
FIG. 9 illustrates the motion of the pad conditioner assembly of the present invention during operation.

The advantage of the present invention will be explained with reference to FIG. 9. As shown in FIG. 9, pad conditioner assembly 102 is moving from right to left as indicated by the arrow and a high friction point 30 exists between one of conditioning elements 24 and the pad surface. In this case, elastic member 60*a* is compressed while elastic member 60*b* is not compressed. In this way, the skip height of the pad conditioner assembly is reduced as compared to the prior art situation and better contact is maintained with the polishing pad. Thus, a topography is not formed in the polishing pad and the down-force or pressure at the center of the wafer is not reduced as in the prior art. Accordingly, uneven polishing is reduced.

Figure 4A:
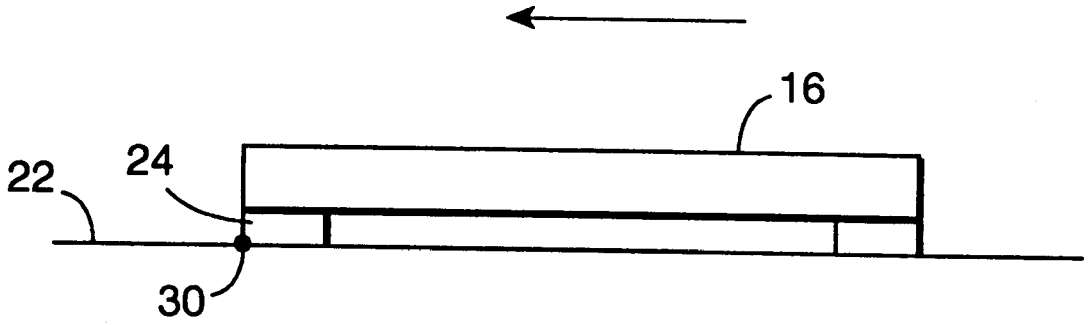
FIG. 4A PRIOR ART
FIGS. 4A and 4B are used to explain the unstable motion of the conditioner assembly of FIG. 1.
Figure 4B:
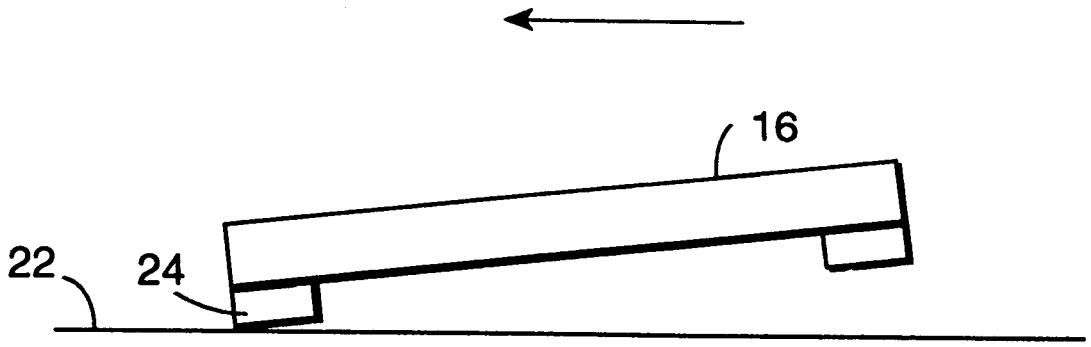
FIG. 4B PRIOR ART
Figure 5A:
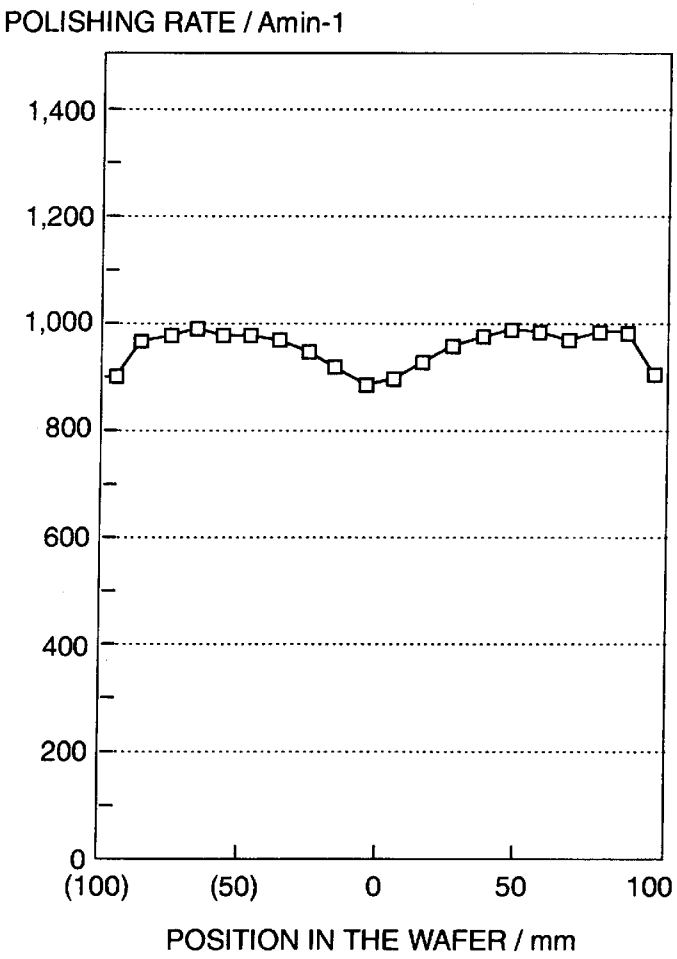
FIG. 5A PRIOR ART
FIGS. 5A and 5B illustrate the polishing rate of a semiconductor wafer after conditioning has been performed three times and thirty times, respectively, using the conditioner assembly of FIG. 1.
Figure 5B:
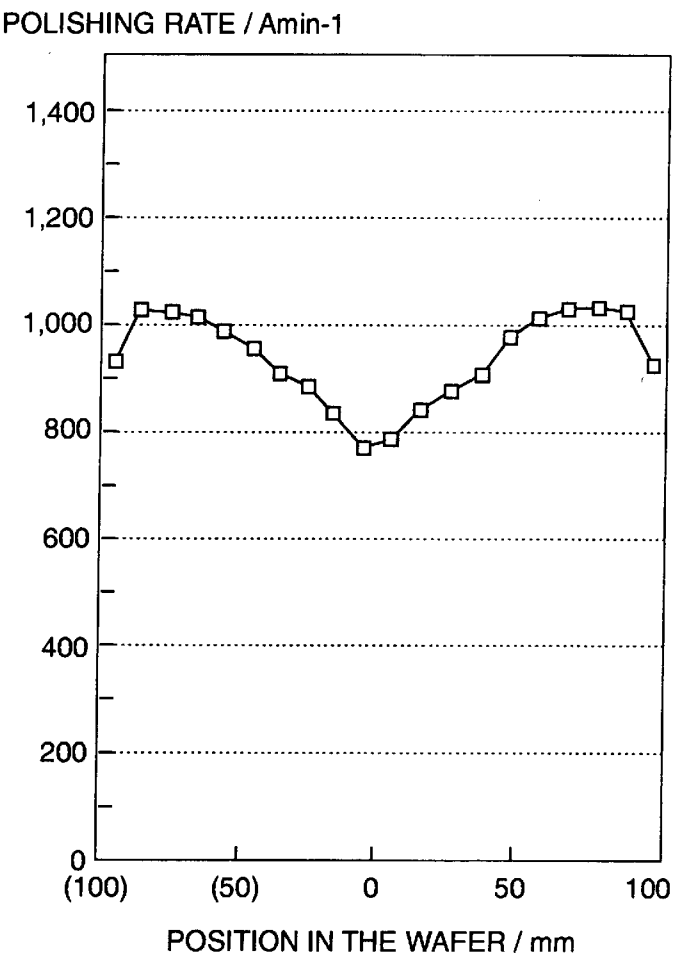
FIG. 5B PRIOR ART
Figure 10:
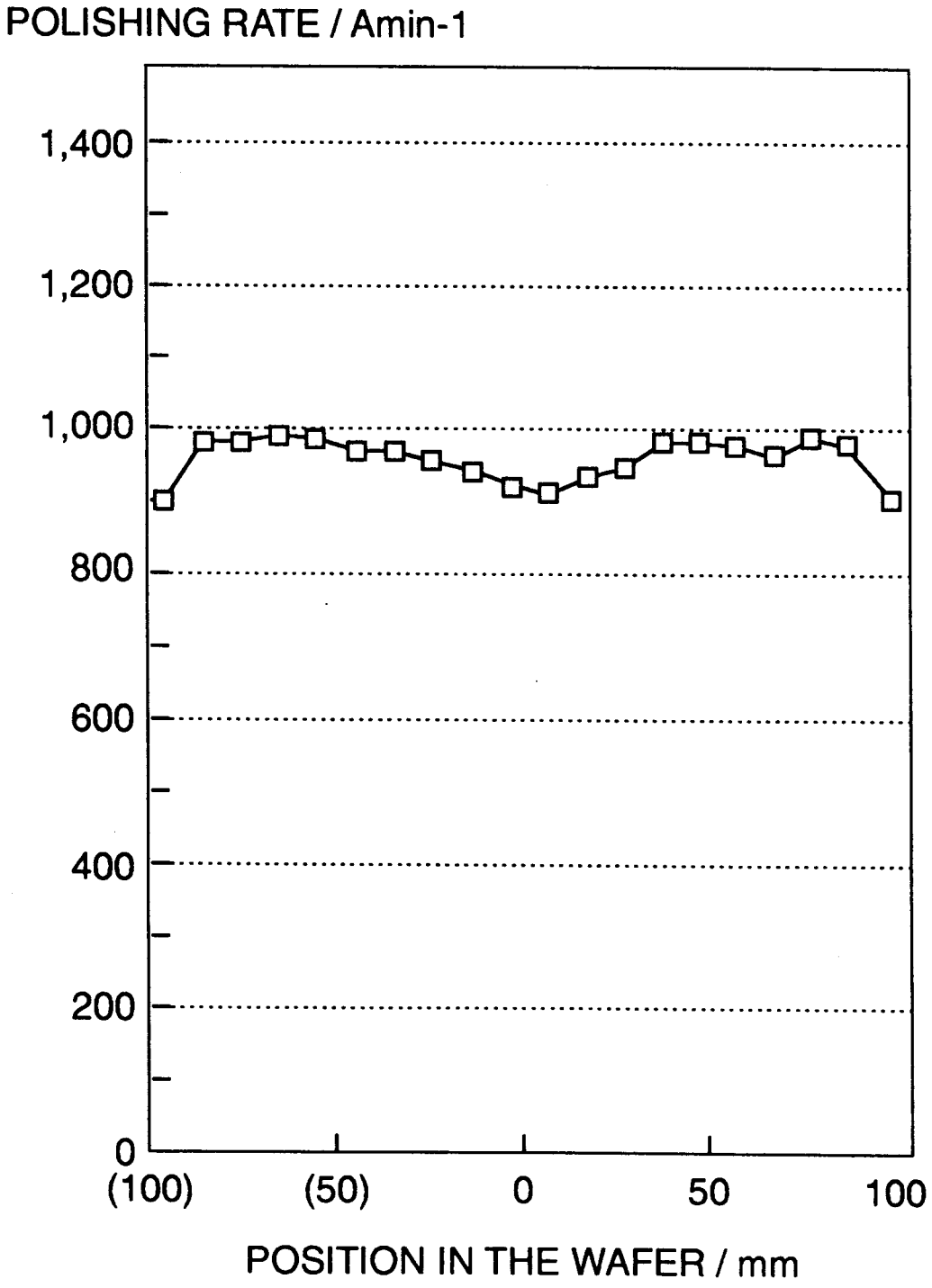
FIG. 10 illustrates the polishing rate of a semiconductor wafer after conditioning has been performed thirty times using the pad conditioner assembly of the present invention.
Figure 11A:
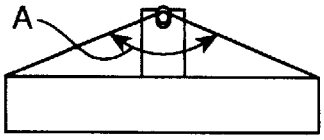
FIGS. 11A and 11B illustrate small and large diameter conditioner assemblies, respectively.
Figure 11B:
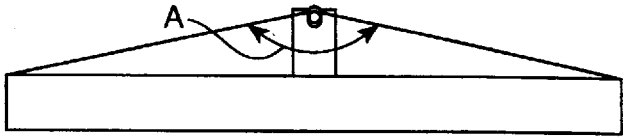

The benefits achieved by the present invention are illustrated in FIG. 10 which illustrates the polishing rate across the wafer after conditioning has been carried out 30 times using elastic members made of polyurethane sponge. It can be seen that the polishing rate across the wafer is between about 900 and about 1000 Angstroms per minute and thus represents a significant improvement over the prior art. Such uniform polishing is critical as devices are made smaller and smaller. The present invention is particularly advantageous in the case of smaller diameter conditioners, e.g., 80 millimeters. Specifically, with reference to FIGS. 11A and 11B, the present invention is particularly advantageous in conditioners where the angle A defined by the universal joint and the conditioner edges is small since the skipping described with reference to FIGS. 4A and 4B is a more significant problem in these arrangements.

Figure 12A:
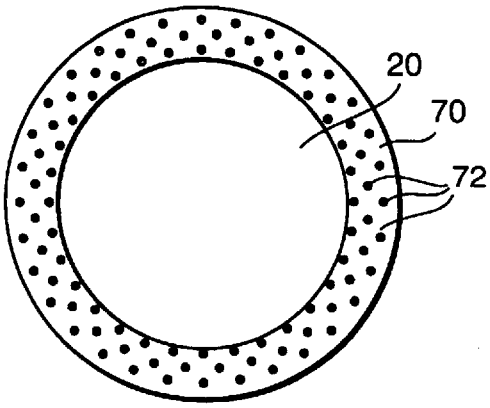
FIGS. 12A and 12B illustrate a pad conditioner assembly in accordance with another embodiment of the present invention.
Figure 12B:
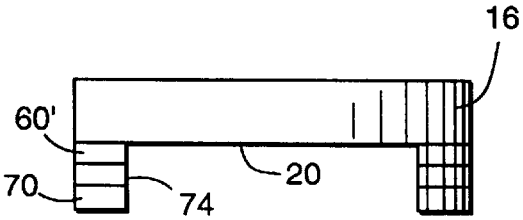
Figure 13A:
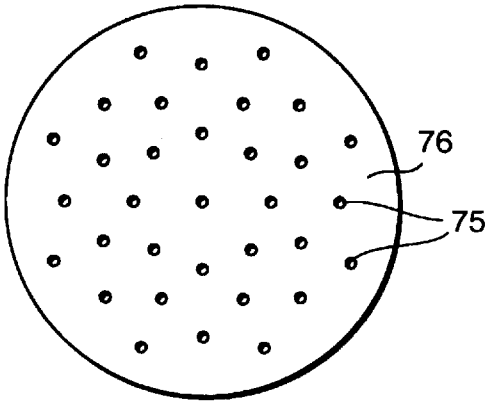
FIGS. 13A and 13B illustrate a pad conditioner assembly in accordance with yet another embodiment of the present invention.
Figure 13B:
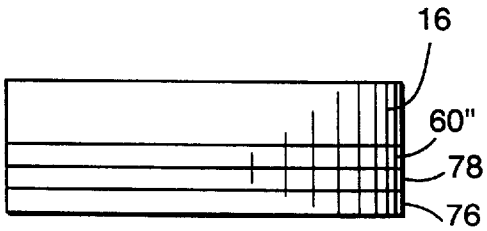

Conditioning elements 24 may be pellets such as diamond pellets which generally exhibit good performance. For example, about 30–40 pellets may be provided to project from the bottom surface of the conditioning element carrier. However, the invention is not limited in this respect. For example, the present invention may be applied to the pad conditioner assemblies shown in FIGS. 12 and 13. The pad conditioner assembly of FIG. 12A includes an annular plate 70 on which diamond particles 72 are arranged. FIG. 12B is a cross-sectional view of the conditioner of FIG. 12A and illustrates diamond particles 72 embedded in an annular nickel-plated layer 70 which is arranged on an annular stainless steel member 74. Elastic member 60' is arranged between stainless steel member 74 and conditioning element carrier 16. FIG. 13A illustrates an arrangement in which diamond particles 75 are embedded in a nickel-plated layer 76 which extends over the entire bottom surface of conditioning element carrier 16. Nickel-plated layer 76 is mounted on a stainless steel layer 78 which is spaced from the conditioning element carrier by an elastic member 60" as shown in the cross-sectional view of FIG. 13B.

The patents identified in the above description are hereby incorporated by reference into this application.

This invention has been described in detail with connection with currently contemplated embodiments. These embodiments are, however, for illustrative purposes only and the invention is not limited thereto. It will be understood by those skilled in the art that other variations and modifications can easily be made within the scope of this invention as defined by the claims.

We claim:

1. A conditioner for a polishing machine which includes a polishing pad, comprising:

a carrier having a bottom surface;

a conditioning element attached to said carrier for conditioning said polishing pad; and an elastic element arranged between said conditioning element and said carrier, wherein said conditioning element is elastically engaged to said bottom surface of said carrier.

2. The conditioner assembly according to claim 1, wherein said conditioning element comprises a plurality of conditioning pellets and said elastic element comprises a plurality of elastic members respectively arranged between said conditioning pellets and said carrier.

3. The conditioner assembly according to claim 2, wherein said conditioning pellets are diamond conditioning pellets.

4. The conditioner assembly according to claim 1, wherein said conditioning element comprises an annular conditioning element.

5. The conditioner assembly according to claim 4, wherein said annular conditioning element comprises an annular nickel conditioning element having diamond particles embedded therein.

6. The conditioner assembly according to claim 5, further comprising an annular steel layer arranged between said annular nickel conditioning element and said elastic element.

7. The conditioner assembly according to claim 1, wherein said conditioning element comprises a disk-shaped conditioning element.

8. The conditioner assembly according to claim 7, wherein said disk-shaped conditioning element is a disk-shaped nickel conditioning element having diamond particles embedded therein.

9. The conditioner assembly according to claim 8, further comprising a steel layer arranged between said disk-shaped nickel conditioning element and said elastic element.

10. The conditioner assembly according to claim 1, wherein said elastic member comprises polyurethane.

11. The conditioner assembly according to claim 1, wherein said elastic member comprises polyisobuthylene.

12. The conditioner assembly according to claim 1, wherein said elastic element is compressed at high friction points on said polishing pad while said carrier is moving on the high friction points.

13. The conditioner assembly according to claim 1, wherein said carrier is connected to a universal joint.

14. The conditioner assembly according to claim 1, wherein said conditioning element is non-elastic.

15. A polishing apparatus, comprising:

a polishing pad;

a first carrier for bringing a semiconductor wafer in contact with said polishing pad; and a conditioner for conditioning said polishing pad, said conditioner including:

a second carrier having a bottom surface;

a conditioning element attached to said second carrier for conditioning said polishing pad; and an elastic element arranged between said conditioning element and said second carrier, wherein said conditioning element is elastically engaged to said bottom surface of said carrier.

16. The polishing apparatus according to claim 15, wherein said conditioning element comprises a plurality of conditioning pellets and said elastic element comprises a plurality of elastic members respectively arranged between said conditioning pellets and said second carrier.

17. The polishing apparatus according to claim 15, wherein said conditioning element comprises an annular conditioning element.

18. The polishing apparatus according to claim 17, further comprising an annular steel layer arranged between said annular conditioning element and said elastic element.

19. The polishing apparatus according to claim 15, wherein said conditioning element comprises a disk-shaped conditioning element.

20. The polishing apparatus according to claim 19, further comprising a steel layer arranged between said disk-shaped conditioning element and said elastic element.

21. The polishing apparatus according to claim 15, wherein said second carrier is connected to a universal joint.

22. The polishing apparatus according to claim 15, wherein said conditioning element is non-elastic.

23. A conditioner for a polishing machine which includes a polishing pad, comprising:

a carrier having a bottom surface;

a conditioning element attached to said carrier for conditioning said polishing pad, said conditioning element having a plurality of conditioning pellets; and an elastic element arranged between said conditioning element and said carrier, wherein said conditioning element is elastically engaged to said bottom surface of said carrier, said elastic element having a plurality of elastic members respectively arranged between said conditioning pellets and said carrier.

24. The conditioner assembly according to claim 23, wherein said conditioning pellets are diamond conditioning pellets.

25. A polishing apparatus, comprising:

a polishing pad;

a first carrier for bringing a semiconductor wafer in contact with said polishing pad; and a conditioner for conditioning said polishing pad, said conditioner including:

a second carrier having a bottom surface;

a conditioning element attached to said second carrier for conditioning said polishing pad, said conditioning element having a plurality of conditioning pellets; and an elastic element aged between said conditioning element and said second carrier, wherein said conditioning element is elastically engaged to said bottom surface of said carrier, said elastic element having a plurality of elastic members respectively arranged between said conditioning pellets and said second carrier.

* * * * *

UNITED STATES PATENT AND TRADEMARK OFFICE

CERTIFICATE OF CORRECTION

PATENT NO. : 5,954,570
DATED : September 21, 1999
INVENTOR(S) : Hiroyuki Yano et al.

It is certified that error appears in the above-identified patent and that said Letters Patent is hereby corrected as shown below:

Title page,
Item [73], Assignee: insert -- Ebara Corporation, Tokyo, Japan -- as an Assignee.

Signed and Sealed this

Tenth Day of September, 2002

*Attest:*

*Attesting Officer*

JAMES E. ROGAN
*Director of the United States Patent and Trademark Office*